US005480709A

United States Patent [19]

Sauvignet

[11] Patent Number: 5,480,709

[45] Date of Patent: Jan. 2, 1996

[54] ELASTIC FABRIC FOR SUPPORT ARTICLES

[75] Inventor: Jean-Pierre Sauvignet, Saint Etienne, France

[73] Assignee: Etablissements Antonine Bertheas & Cie, France

[21] Appl. No.: 396,427

[22] Filed: Feb. 28, 1995

[30] Foreign Application Priority Data

Mar. 3, 1994 [FR] France ..... 94 02682

[51] Int. Cl.[6] ..... D03D 3/00

[52] U.S. Cl. ..... 428/231; 428/229; 428/230; 428/257; 428/258; 428/259; 428/225

[58] Field of Search ..... 428/229, 230, 428/231, 257, 225, 258, 259

[56] References Cited

U.S. PATENT DOCUMENTS 5,358,767 10/1994 Bompard et al. ..... 428/229

FOREIGN PATENT DOCUMENTS 715627 4/1931 France .
9312593 8/1993 Germany .

*Primary Examiner*—James J. Bell
*Attorney, Agent, or Firm*—Harris Beach & Wilcox

[57] ABSTRACT

A fabric having a high degree of elasticity in the warp direction. The warp is composed of at least three types of yarns working according to different weaves including a highly elastic yarns of the covered yarn type, two series of ground thread yarns and a series of yarns called binding threads.

4 Claims, 4 Drawing Sheets

ELASTIC FABRIC FOR SUPPORT ARTICLES

BACK TO THE INVENTION

Figure 1:
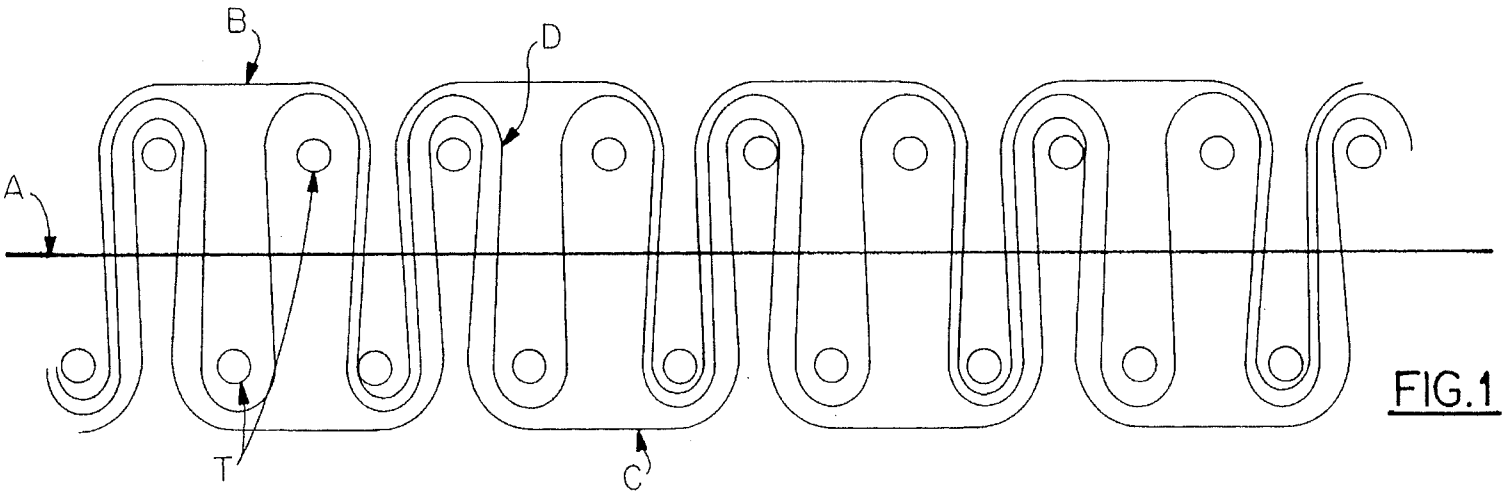

The present invention relates to a novel type of woven fabric having a high elasticity in its length direction (warp direction), blocked widthwise, and a high springback capacity (support effect), which is usable in the paramedical field in order to produce bandages, knee supports, elbow supports, lumbar corsets, etc. and, in general, for everything in the "orthopedic garment-making" field.

In the field of orthopedic garment-making, woven fabrics are used which, in general, consist of a hybrid warp composed of highly extensible yarns making it possible to give a fabric elasticity and yarns making it possible not only to provide comfort but also the degree of support that it is desired to obtain, and the filling itself being constituted by a man-made yarn, making it possible to obtain an article having a flat appearance and an appropriate strength, such as a monofilament man-made yarn or the like.

Hitherto, in order to produce such articles, a warp is used which is a combination of highly elastic yarns of the "covered yarn" type, which consist of a core made of rubber or preferably of elastofibers, such as elastane, and of cotton yarns, weaving being performed under conditions such that the cotton yarns appear at the surface and conceal the elastic yarns which remain positioned in the central part of the fabric. However, such elastic yarns, although satisfactory as regards the degree of support that they enable-to be achieved and the comfort for the wearer, have a certain number of drawbacks, namely that, in particular, of tearing during manufacture and of having an abrasion resistance often deemed to be insufficient.

Moreover, when they are being used, it is generally necessary to be able to join together the two furthermost edges of the web of fabric after it has been put in place on the patient. In addition to the solution consisting in attaching hooks or loops at each end, self-grabbing structures, of the type of that marketed under the "VELCRO" trademark, are increasingly being used, one of the ends of the web including the male part in the form of hooks and the other the female part in the form of little loops. Such a procedure therefore leads to a significant excess of thickness in the region of the junction, which may be annoying; in addition, when fastening the male and female parts, it very often turns out that the surface of the extensible fabric is damaged in the vicinity of the region which includes the female strip.

SUMMARY OF THE INVENTION

Now, a fabric has been found, and it is this which forms the subject of the present invention, which not only has improved characteristics in terms of comfort, strength, etc., with respect to the prior solutions, but which, moreover, according to one embodiment, also makes it possible to obtain a structure such that it avoids having to put in place, at one end of the web, the female self-grabbing element of the assembly for connecting the ends.

In general, the invention therefore relates to a novel type of fabric having a high degree of elasticity in its warp direction, of the type comprising a hybrid warp composed of highly extensible yarns making it possible to give the fabric elasticity, yarns making it possible to provide comfort and feel as well as to adjust the degree of support, and the filing itself being constituted by a man-made monofilament yarn (bristle), and the weave being such that, after production, the elastic yarns remain positioned in the central part of the fabric and are concealed by the comfort-providing yarns, wherein the warp is composed of at least three types of yarns of different kinds working according to different weaves with respect to the weft yarns, namely:

- highly elastic yarns of the "covered yarn" type working according to a plain weave;
- two series of yarns called "ground threads" consisting of textured man-made yarns and working according to a weave such that they form floats visible on both faces after production, at least one of these series of yarns consisting of elementary filaments as fine as possible;
- a series of yarns called "binding threads" consisting of textured man-made yarns working according to a taffeta weave and keeping the highly extensible yarns in the central part of the fabric and blocking the ground threads.

According to one embodiment in accordance with the invention, according to which the fabric has two plain, identical, outer faces, the two series of ground threads are constituted by false-twist textured multifilament man-made yarns, each filament having an individual count as small as possible and in general of the order of 0.9 to 1.2 dtex, said yarns working according to a rib weave.

According to a variant, the two series of ground threads consist of two types of different yarns also working according to different weaves, namely:

- one, working according to a rib weave, being based on textured multifilament man-made yarns, the filaments of which have a count as fine as possible,
- the other, being constituted by a false-twist textured yarn, working according to a weave composed of an alternation of taffeta regions and of long floats.

In this embodiment, an article is obtained in which one of the faces is plain and smooth and the other face of which has visible little loops.

In such a case, the binding thread is preferably associated with a heat-meltable yarn making it possible, after treatment, to obtain perfect blocking of the visible little loops.

BRIEF DESCRIPTION OF THE INVENTION

Figure 4:
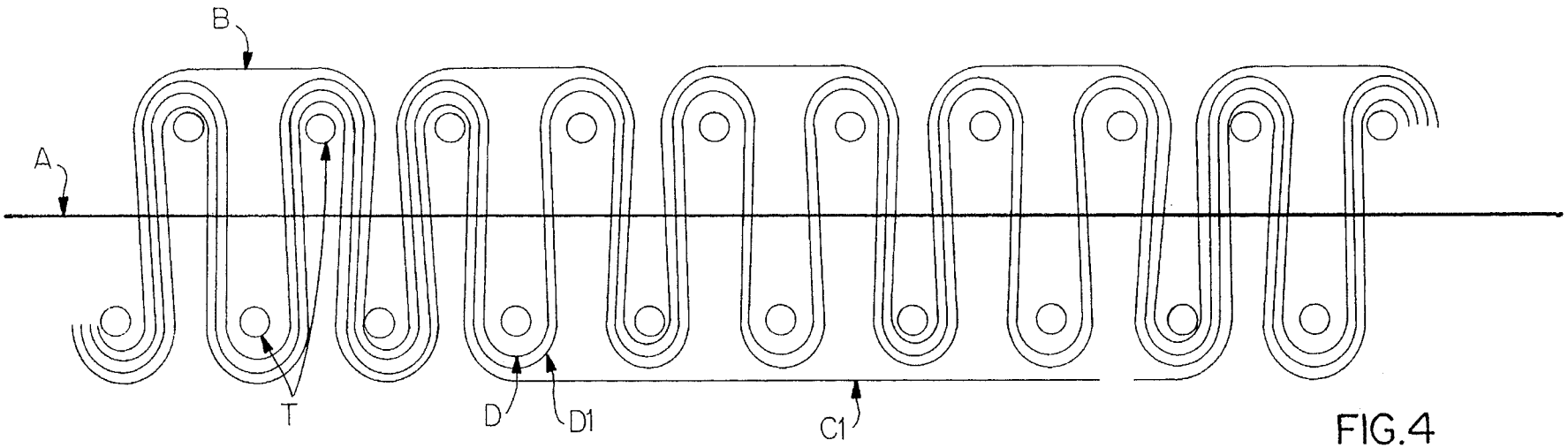
Figure 2:
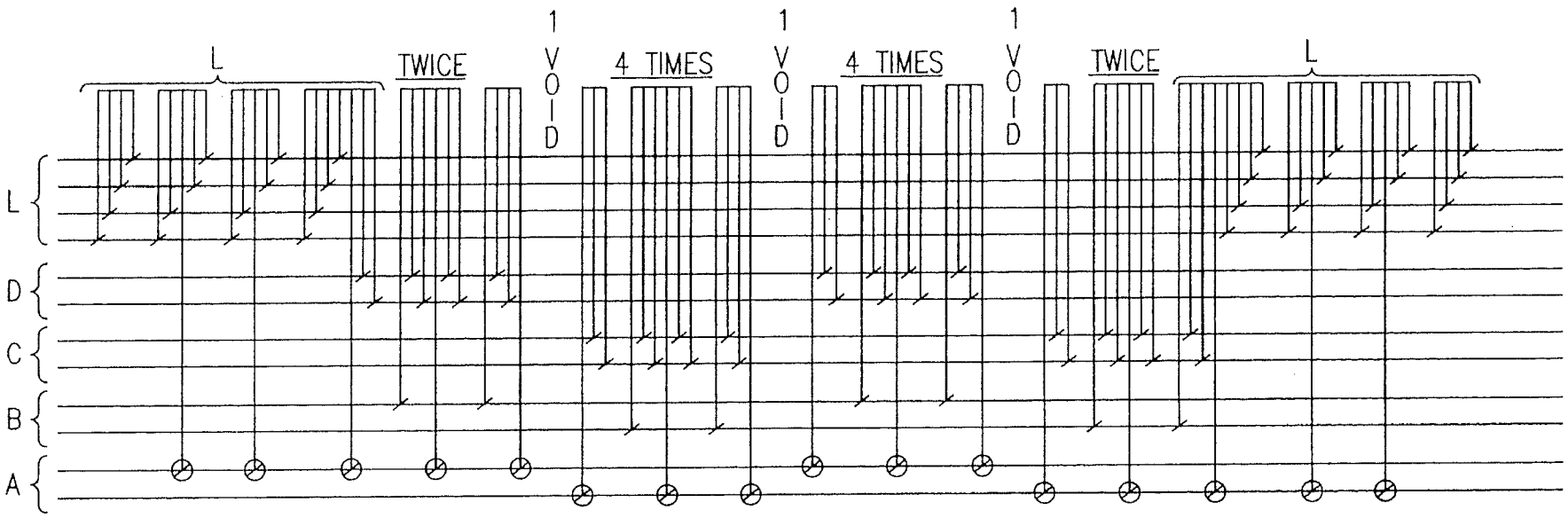
Figure 3:
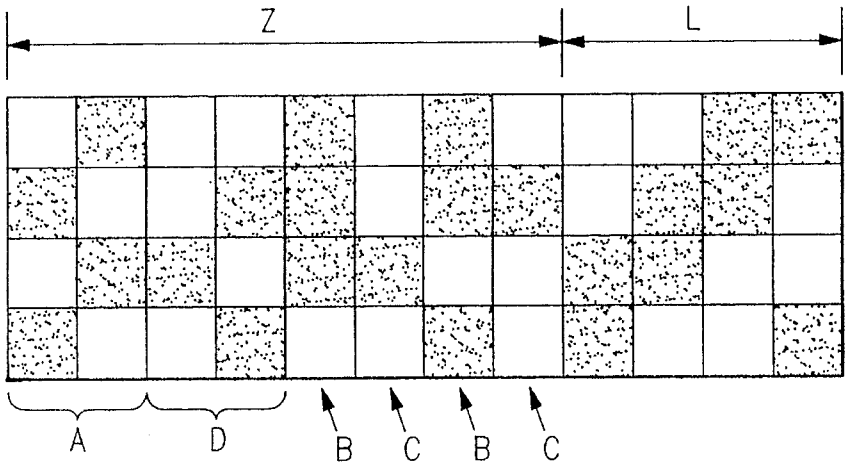
Figure 5:
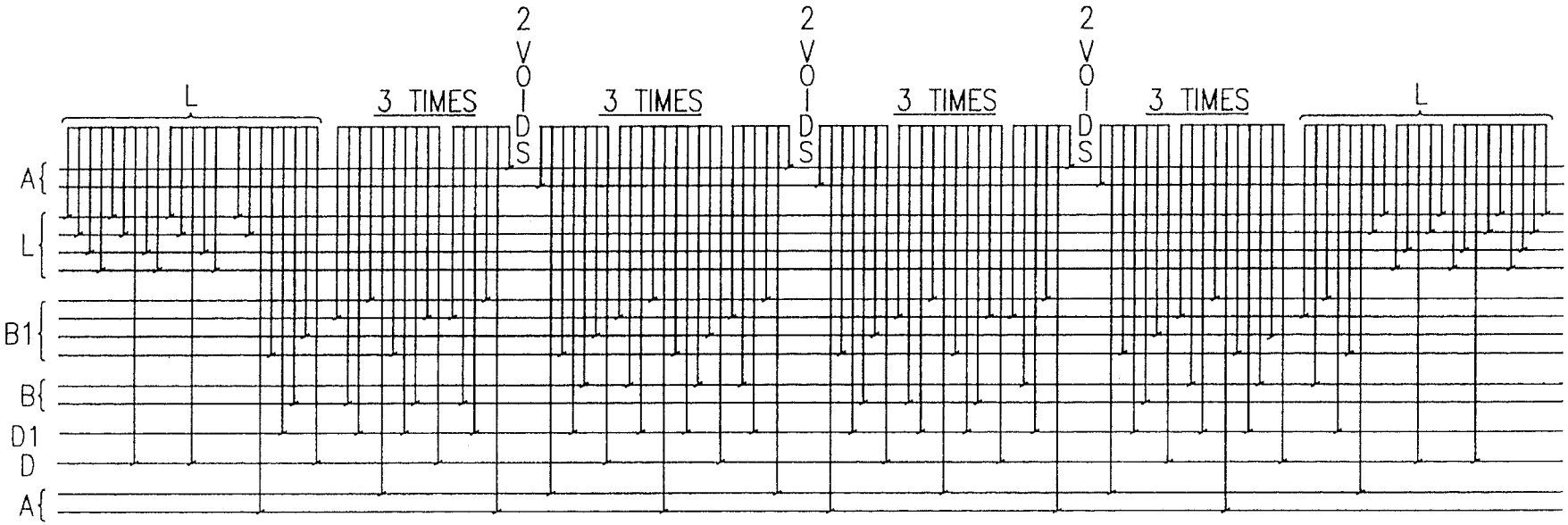
Figure 6:
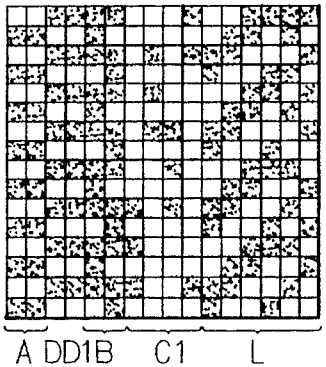
Figure 7:
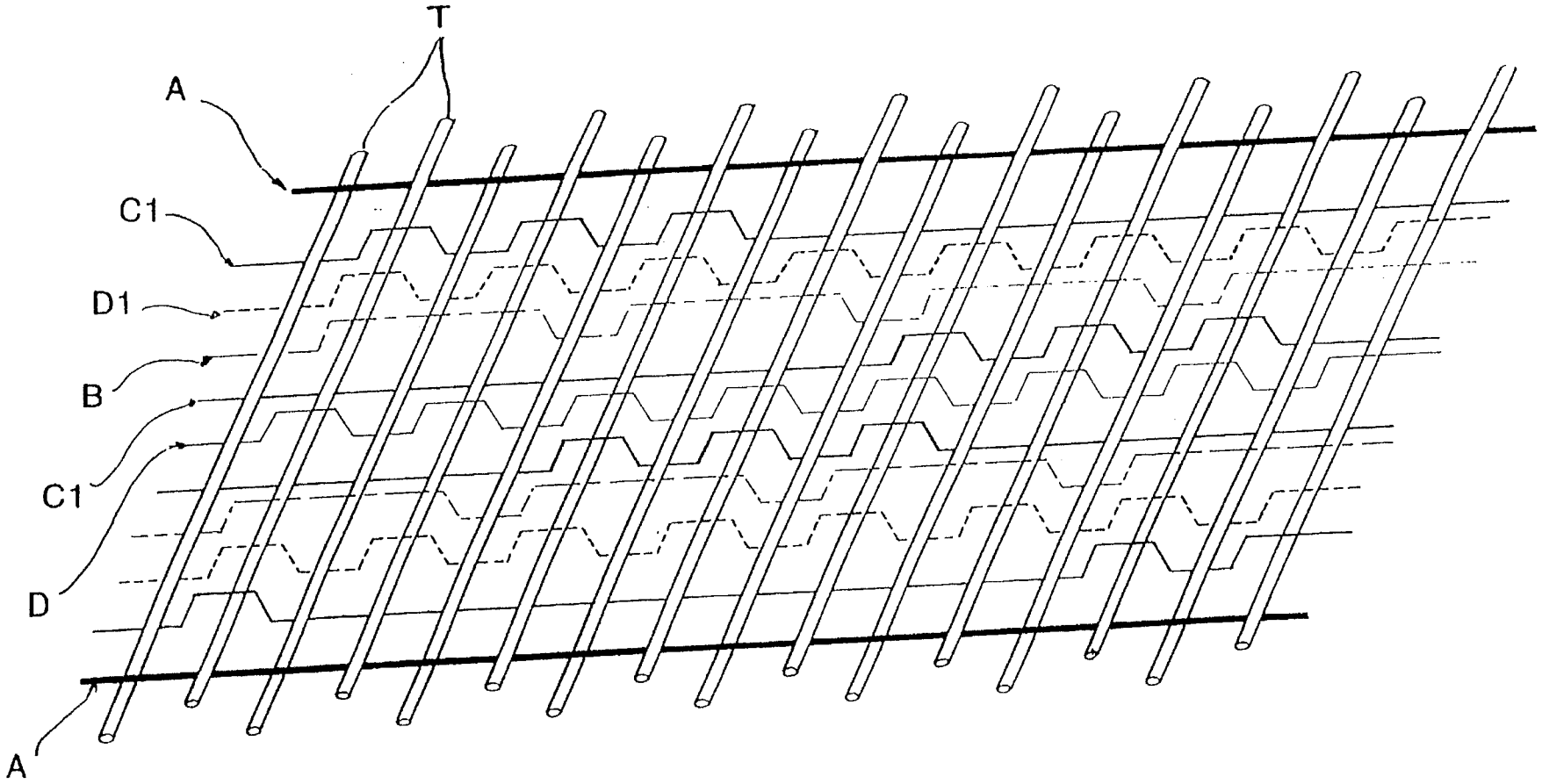

The invention and the advantages that it provides will, however, be more understandable by virtue of the two illustrative embodiments given hereinbelow by way of indication, but implying no limitation, and which are illustrated by the appended diagrams in which:

FIGS. 1, 2 and 3 are graphical representations produced conventionally and enabling a person skilled in the art to reproduce, exactly, a first embodiment of the fabric produced in accordance with the invention, and which show:

- FIG. 1: the working and positioning of the various types of warp yarns involved in the production of such a fabric,
- FIG. 2: a weave repeat;
- FIG. 3: the loom threading-in instructions and;

FIGS. 4 to 7 illustrate another embodiment of an extensible fabric in accordance with the invention, having visible small loops on one of its faces, FIGS. 4 to 6 being graphical representations similar to FIGS. 1 to 3, FIG. 7 itself being a diagrammatic perspective view of the structure of such a fabric.

DESCRIPTION OF THE INVENTION

In the first embodiment illustrated by FIGS. 1 to 4, the extensible fabric in accordance with the invention is produced on a conventional loom with a reed number of 7¾ dents to the centimeter.

The filling is constituted by a nylon bristle of 330 dtex, the loomstate reduction being 58 picks to the inch (58 pick insertions in 27.7 mm).

As warp yarns, a combination of different yarns will be used, in accordance with the invention, these comprising:

elastic yarns (A) composed of a core made of an elastane yarn such as, for example, a yarn marketed under the "LYCRA" trademark, of 1240 dtex and covered by two layers of covering yarns, which layers are oriented in reverse directions to each other and consisting of a 2/85 dtex/ 92-filament linear-density false-twist textured nylon yarn;

two series of identical yarns (B, C), called "ground threads", each yarn being a 2/85 dtex/ 92-filament linear-density false-twist textured nylon yarn;

and a series of yarns (D) called "binding threads", consisting of a 2/78 dtex/23-filament false-twist textured nylon yarn.

The working cycle of the warp yarns (A, B, C, D) with respect to the filling yarns T is performed according to the weave illustrated by FIGS. 1 and 2, the threading arrangement being illustrated in FIG. 3.

Referring to this FIG. 3, the side regions (L) correspond to the arrangement'and the working of the warp yarns at each selvage. The central part itself is multiplied as many times as necessary depending on the width of the fabric that it is desired to produce and works according to the weave corresponding to the region (Z) of FIG. 2, that is to say according to a repeat of8 ends/five picks.

As will appear from the appended diagrams, the highly elastic yarns (A) work according to a plain weave, the two series of ground threads (B, C) themselves working according to a weave, namely a "3-rib" type weave, making it possible to form floats of short length on the two external faces of the fabric after production.

Finally, as regards the binding threads D, these also work according to a taffeta weave.

During weaving, the yarns (A) are held under the maximum tension while the textured yarns (B, C, D) are held under the minimum tension which allows weaving.

At the fall from the loom, when the fabric is produced, the highly elastic yarns retract and end up being positioned in the central part of the fabric, while the ground threads (B, D) end up at the surface.

By working in such a manner, a woven elastic fabric is obtained which has a flat appearance, making it possible to obtain grip forces of 100 to 700 cN/cm for a 30% elongation, depending on the count of the elastane core used. Such a fabric may be dyed and printed.

Given the very great flexibility of the filaments constituting the yarns which appear at the surface, an article is obtained which has a particularly high density which, compared to the prior articles in which the surface was constituted by cotton natural fibers, has the following advantages, namely of being lighter and having a very great water permeability, a capillary draining effect and a very soft feel.

Moreover, such an article preserves a natural cotton-type appearance and not the usual appearance of chemical fibers. On the other hand, it has the advantages of such chemical fibers, namely a very low shrinkage when washing and rapid drying, even in ambient air.

Finally, it is exceptionally comfortable on the skin, due to the very great fineness of the manmade fibers appearing at the surface.

FIGS. 4 to 7 illustrate a second embodiment of an extensible fabric for support articles in accordance with the invention.

As seen previously, for the weft, a polyamide nylon bristle of 16/100 th of a millimeter in diameter is used.

The warp yarns are constituted by the combination of the following man-made yarns:

elastic yarns (A) similar to those of the previous example;

ground threads consisting, on the one hand, of yarns (B) similar to the previous example and, on the other hand, of yarns (C1), this being a 2/110 dtex/ 5-filament false-twist textured nylon yarn;

binding threads consisting, on the one hand, of a 2/78 dtex/ 23-filament linear-density false-twist textured nylon yarn (D) and, on the other hand, of a 235 dtex linear-density copolyamide meltable yarn (D1) whose melting point is of the order of 110° C.

Weaving is performed in accordance with FIGS. 5 to 8, from which it is apparent that the elastic yarns and the binding threads (D–D1) work according to a taffeta weave, while the ground threads work, one (B) according to a 3-rib weave so that they form loops on one of the faces of the fabric and the other (C1) according to a weave composed of an alternation of taffeta regions and of long floats located on the opposite face to the floats formed by the yarn (B).

By working in this manner, a two-faced elastic fabric is obtained in which the lower face is similar in all points to the fabric of the first embodiment and the upper face of which is covered with small loops formed by the floats, enabling this face to be able to act as a female self-grabbing element interacting with a male element of the conventional self-grabbing structures.

It is therefore possible, from such a fabric, to produce support strips of a predetermined length, to which a male part of a self-grabbing structure is attached only at one end.

As in the previously mentioned example, contact with the skin, provided by the smooth surface, is particularly comfortable.

Moreover, it should be noted that, since the products manufactured in accordance with the invention are based on man-made yarns, they may be cut using ultrasonic techniques. Moreover, in the second embodiment, the melting of the heat-meltable fibers makes it possible to obtain perfect and effective blocking of the visible little loops, preventing them from being torn out when installing or removing the support element.

I claim:

1. A fabric for support-articles, having a high degree of elasticity in its warp direction, of the type comprising a hybrid warp composed of highly extensible yarns (A) making it possible to give the fabric elasticity, yarns making it possible to provide comfort and the feel as well as to adjust the degree of support, and the filling (T) itself being constituted by a man-made monofilament yarn (bristle), and the weave being such that, after production, the elastic yarns (A) remain positioned in the central part of the fabric and are concealed by the comfort-providing yarns, wherein the warp is composed of at least three types of yarns of different kinds working according to different weaves with respect to the weft yarns, namely:

highly elastic yarns (A) of the "covered yarn" type working according to a plain weave;

two series of yarns (B, C) called "ground threads" consisting of textured man-made yarns and working according to a weave such that they form floats visible on both faces after production, at least one of these series of yarns consisting of elementary filaments as fine as possible;

a series of yarns called "binding threads" consisting of textured man-made yarns working according to a taffeta weave and keeping the highly extensible yarns (A) in the central part of the fabric and blocking the ground threads (B, C).

2. The extensible fabric as claimed in claim 1, wherein it has two identical outer faces, the two series of ground threads (B, C) being constituted by false-twist textured multifilament man-made yarns, each filament of which having an individual count as small as possible and in general of the order of 0.9 to 1.2 dtex, said yarns (B, C) working according to a rib weave.

3. The elastic fabric as claimed in claim 1, wherein the ground threads are composed of two types of different yarns (B, C1), working according to different weaves, namely:

one (B), working according to a rib weave, being based on textured multifilament man-made yarns, the filaments of which have a count as fine as possible, the other (C), being constituted by a false-twist textured yarn, working according to a weave composed of an alternation of taffeta regions and of long floats, said fabric being such that, after production, one of its faces is smooth and the other has visible little loops.

4. The fabric as claimed in claim 3, wherein the binding threads (D) are combined, during weaving, with heat-meltable yarns (D1) making it possible, after treatment, to obtain perfect blocking of the visible little loops formed by the yarn (D1).

* * * * *